US007398863B2

(12) United States Patent
Liebetrau et al.

(10) Patent No.: US 7,398,863 B2
(45) Date of Patent: Jul. 15, 2008

(54) SAFETY DEVICE FOR ELEVATORS

(75) Inventors: Christoph Liebetrau, Menziken (CH); Ruedi Stocker, Buchrain (CH); Esben Rotboll, Zug (CH)

(73) Assignee: Inventio AG, Hergiswil NW (CH)

( * ) Notice: Subject to any disclaimer, the term of this patent is extended or adjusted under 35 U.S.C. 154(b) by 438 days.

(21) Appl. No.: 10/667,874

(22) Filed: Sep. 22, 2003

(65) Prior Publication Data

US 2004/0112683 A1 Jun. 17, 2004

(30) Foreign Application Priority Data

Sep. 23, 2003 (EP) ..... 02405819

(51) Int. Cl.
*B66B 5/12* (2006.01)

(52) U.S. Cl. ..... 187/367; 187/372; 187/376; 187/406; 188/72.2

(58) Field of Classification Search ..... 187/287, 187/367, 368, 372, 376, 379; 188/189, 72.2, 188/72.6, 72.7, 72.8, 136; *B66B 5/16, 5/18*
See application file for complete search history.

(56) References Cited

U.S. PATENT DOCUMENTS 5,002,158 A * 3/1991 Ericson et al. ..... 187/254
5,160,451 A 11/1992 Eidenschink
5,224,570 A * 7/1993 Fromberg ..... 187/376
6,012,553 A * 1/2000 Liebetrau et al. ..... 187/367
6,082,506 A * 7/2000 Huang et al. ..... 188/189
6,173,813 B1 * 1/2001 Rebillard et al. ..... 187/287
6,758,310 B2 * 7/2004 Muff et al. ..... 187/370

FOREIGN PATENT DOCUMENTS

| | | |
|---|---|---|
| DE | 805 782 | 5/1951 |
| DE | 37 06 802 | 9/1988 |
| EP | 0 841 280 | 5/1998 |
| EP | 0 870 719 | 10/1998 |
| EP | 1 067 084 | 1/2001 |

* cited by examiner

*Primary Examiner*—Peter M. Cuomo
*Assistant Examiner*—Stefan Kruer
(74) *Attorney, Agent, or Firm*—Fraser Clemens Martin & Miller LLC; William J. Clemens

(57) ABSTRACT

A safety device brakes an elevator car with a guide rail exhibiting an oblong guide flange. The safety device includes a base carrying a retaining element and an abutment with the guide flange positioned therebetween. A mechanism squeezes, when braking, a braking element blocking roller between the guide flange and the abutment. The mechanism, co-operating with an electromagnet, moves the braking element in a controlled way between different positions associated with different operating conditions of the safety device.

17 Claims, 13 Drawing Sheets

SAFETY DEVICE FOR ELEVATORS

BACKGROUND OF THE INVENTION

The present invention relates generally a safety device for elevators to prevent unintended elevator car movement.

For guiding the elevator car in the case of elevators with guide rails, guide shoes, which are arranged at the elevator car, are employed and such guide shoes are developed either as roller guide shoes or as sliding guide shoes. In the first case, rollers are generally provided with so-called two-dimensional or three-dimensional guides, which roll on appropriate guide surfaces of the guide rail. In the second case, slideway linings slide with small free motion along the guide rails, so that they confer to the elevator car during the vertical transport motion a guide in the horizontal plane. Safety devices, which are physically separate from the guide shoes, are fastened to the elevator car and such safety devices operate to engage the guide rail.

The well-known devices of this kind work in the manner that in case of exceeding the speed limit of the elevator car or respectively in case of over-speed, the safety device is mechanically operated by a speed governor device.

The common safety devices of the state of the art can be categorized according to their construction either to the group of the brake safety devices or the group of the wedge blocking safety devices or the roller blocking safety devices.

A brake safety device is shown in the U.S. Pat. No. 6,131,704, which has a slideway for guiding the elevator car along the guide rail. This safety device includes a forked lever mechanism and a relatively large and heavy electromagnet. With this safety device, the guiding apparatus is functionally separated from the braking device or respectively from the safety device. The usage of such a safety device is therefore uneconomical in particular in the case of low cost elevators with small hoisting height, that is to say for buildings with few floors and low hoisting speeds of the elevator car.

In the case of wedge blocking safety devices or roller blocking safety devices, a loose wedge or loose roller is engaged on a side of the guide rail in order to fit between the stationary guide rail on the one hand and an associated abutment of the safety device on the other hand, by means of the speed limiter, while the safety device block is supported on the opposite side of the guide rail. The prevailing frictional circumstances lead to a further blocking of the clamp body or respectively of the blocking roller and consequently to the braking of the elevator car. Such a blocking roller safety device is described for example in the published European application EP 0 870 719 A1.

Conventional safety devices are applied only in the case of over-speed or in case of inspection work (typically twice per year). Traditional safety devices are in particular of major disadvantage if the elevator car stands at a floor and due to loading, it slips or it falls uncontrolled.

According to the state of the art, an additional so-called creeping protection device prevents the slipping of the elevator car. Thereby, a bolt is pushed into engagement, for example in the appropriate openings of the guide rail, during each stop at a floor, so as to hold in each case the elevator car at the floor level. Further details about the construction and the function of such a creeping protection device are shown in the published European application EP 1 067 084 A1.

A task of the following described invention is therefore to avoid the mentioned disadvantages of the state of the art devices and to create an improved safety device for elevators.

SUMMARY OF THE INVENTION

The safety device according to the present invention has the advantage that it allows, in an excellent manner, an engagement of the safety device in the case of an operating state below the over-speed, that is not so easily possible with the well-known safety devices. Conventional safety devices are never operated in normal operation of the elevator car below the over-speed, which, as a consequence, also makes impossible the early recognition of a possible malfunctioning of the safety device.

A further advantage of the safety device according to the present invention is that it can also be employed as a multi-functional brake device and guiding device for elevators, since it represents a device, which can substitute into one and the same construction three otherwise separated functional units to be employed on an elevator car: these are a guiding device for the elevator car, a safety device and a creeping protection device.

The position of a braking element of the safety device is changeable in a controlled way. Thanks to pre-definition of different positions of the braking element, the safety device can be transferred into different operating states and different functions of the safety device are to be assigned in each case to these different operating states. A mechanism determining the positioning of the braking element allows keeping, in a normal state, the braking element distant from the guide surface of the guide rail. In this normal state, the safety device does not display a braking effect. This normal state of the safety device is adequate for a normal undisturbed drive of the elevator car. The position of the braking element can be changed in a controlled way in such a manner that the braking element touches the guide surface at the guide rail and it is additionally so positioned opposite an abutment that the braking element is not squeezed between the guide surface and the abutment. In this arrangement, the brake is to be arranged in braking readiness, i.e. a state of the readiness for braking. If the safety device is transferred into this state, then a further movement of the elevator car can be possible to a certain extent, since the safety device is not blocked in this state. In the state of braking readiness, an interaction of the braking element with the guide rail is however possible, for example by friction. This interaction between braking element and guide rail makes it possible that the braking element—in a state of braking readiness—is moved in case of a further movement of the elevator car relative to the remaining components of the safety device and opposed to the direction of motion of the elevator car. In case of suitable arrangement of the abutment, the position of the braking element can be changed in such a manner that the braking element comes in addition automatically in contact with the abutment and is squeezed between the guide surface of the guide rail and the abutment. This position of the braking element is called a brake position. In this position, the braking element is blocked and the safety device is arranged in the safety position and in this safety position, a further drive of the elevator car is prevented by the fact that the guide rail is held between the braking element and a retaining element of the safety device.

This safety device can be constructed as a creeping protection device or respectively as a sliding safety device, by transferring the safety device, in case of a stop, into the state of braking readiness. If, under these premises, the elevator car should be additionally loaded, so that the suspension means of the elevator car are stretched and the elevator car is lowered, then the braking element would be moved relative to the safety device. As described above, the safety device can be brought thereby into the safety position, if the elevator car is lowered at least by a defined minimal distance. In case of a suitable arrangement of the abutment, a slipping of the elevator car can thus be prevented, if the elevator car threatens to drop due to an overload.

In case of this safety device, any reversible controlled transition between the normal condition and the condition of the braking readiness can be realised.

This safety device can also serve as guiding device for the elevator car along the guide rail. The retaining element of the safety device is arranged in such a manner that it acts, in normal state of the safety device, as a guiding device for guiding the elevator car alongside the guide rail. The range of motion in a plane perpendicularly to the direction of motion of the elevator car can be arbitrarily limited by further guiding devices. In this way, a guide for guiding the elevator car alongside the guide rail can be functionally integrated into the safety device thanks to a suitable arrangement of the safety device. Such a guide is usually realised, in conventional elevator systems, independently from a safety device with the help of separated guide shoes. The combination of a safety device and of a guiding device or respectively the integrating of a guide into a safety device is particularly economical and entails a favourable weight saving and space saving. The safety device enables a construction in a particularly compact form. For example, the retaining element, and/or one or more guiding elements, and/or the abutment can be developed as part of the walls of a housing for the safety device. This housing can also be constructed as single piece and offers the basis for a simple modular construction of the safety device according to the present invention.

For the safety device, a constructive simple embodiment results if the braking element is developed as blocking roller. This execution form enables a reliable transition of the safety device from the state of the braking readiness into the safety position. This transition is connected with an rolling motion of the blocking roller, which is simply controllable and which can automatically take place by itself even in case of increasing wear of the retaining element and/or of the blocking roller.

The operating mechanism for the positioning of the braking element can be realized in a simple way with the help of an electromagnet. By a suitable pre-definition of the current flowing through the electromagnet, forces can be varied, and with the assistance of these forces, the braking element can be brought in each case into the desired position. Such an operating mechanism can be controlled in a simple manner electronically.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
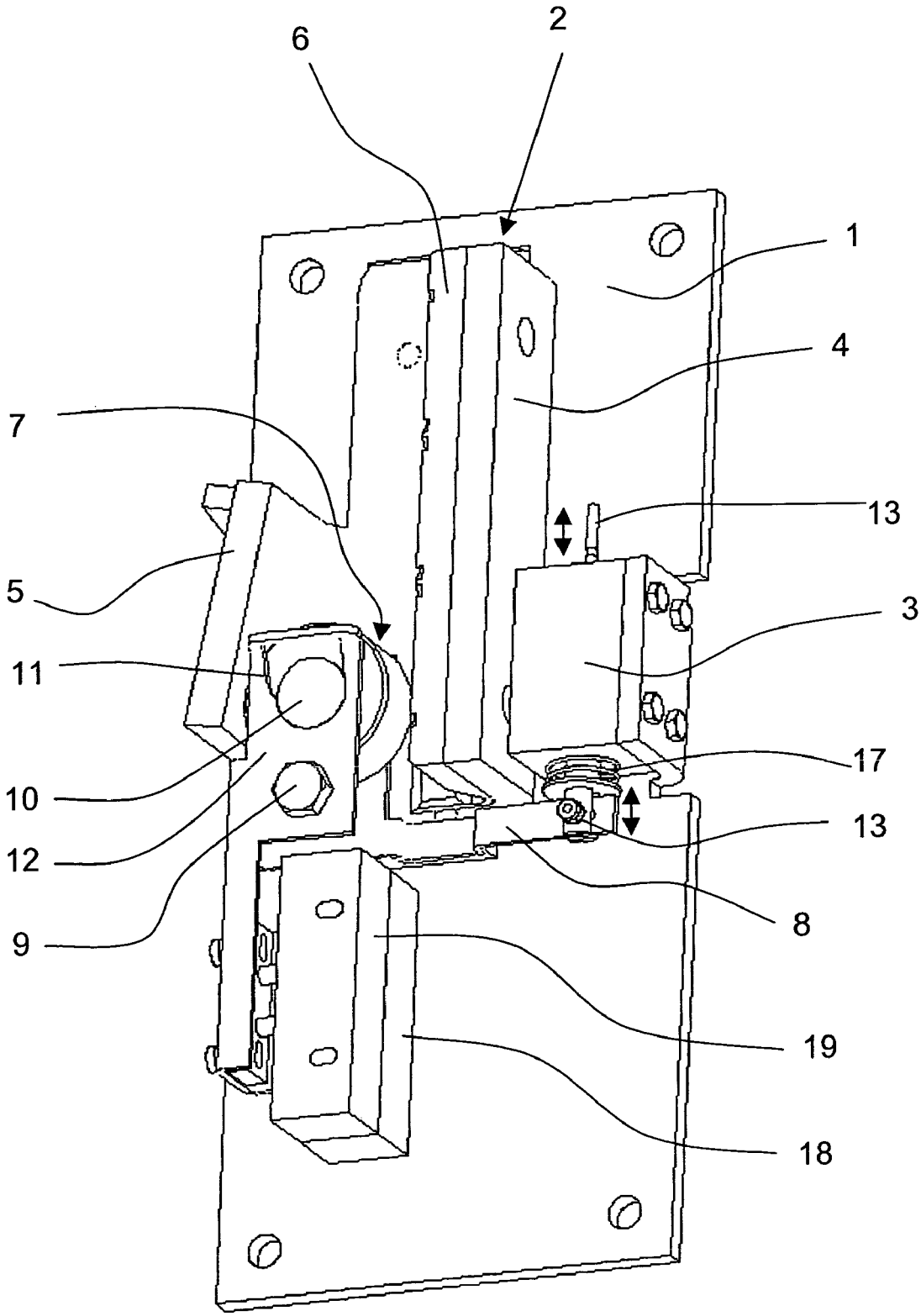
FIG. 1 is a perspective view of a safety device according to the present invention with a blocking roller as a braking element and an electromagnet for operating the safety gear.

FIG. 1 shows a base 1, on which a safety device block 2 and an electromagnet 3 of the safety device are firmly installed. The safety device block 2 has a U-shaped cross section formed by two legs 4 and 5, whereby the inside of the leg 4 is provided with a guide and brake lining 6. The safety device is installed on an elevator car (not shown) in an elevator system (not shown) and at the same time is aligned on a guide rail 30 (see FIG. 14), which serves for guiding the elevator car, in such a manner that a guide flange 31 (see FIGS. 4 and 14) of the guide rail 30 is arranged between a braking element, which is developed in the present case as a blocking roller 7, and the guide and brake lining 6.

In operation, the guide and brake lining 6 touches a guide surface 32 (see FIG. 14) of the guide flange 31. The leg 4 forms together with the guide and brake lining 6 an oblong retaining element for the guide flange 31. With the safety device, the elevator car can be held or respectively braked at the guide flange 31, whereas the guide flange 31 is held between the guide and brake lining 6 and the blocking roller 7. The other leg 5 is arranged inclined and represents thus an abutment for the blocking roller 7. So that the elevator car can be braked against a direction of motion, the space between the leg 5 and the lining 6 is narrowed in opposition to the direction of motion in such a manner that the blocking roller 7 can be squeezed between the leg 5 and the guide flange 31. As clearly shown in FIG. 1, in the present case the space between the leg 5 and the guide and brake lining 6 is upwards reduced. The safety device represented in FIG. 1 is therefore suitable to react against a descent of the elevator car.

A lever mechanism 8 is operated by an operating mechanism including the electromagnet 3, whereby the lever mechanism 8 is mounted for swivelling around an axle 9, which is arranged parallel to a longitudinal surface of the guide and brake lining 6 and perpendicularly to the direction of motion of the elevator car. Preferably, a free end of the lever mechanism 8 is coupled with the electromagnet 3. Thereby, the location of the blocking roller 7 in the mentioned interspace can be changed depending upon the operating state, preferably in that way that the position of an axle 10 of the blocking roller 7 is changeable along a guide 11 of the lever mechanism 8, for example via rolling of the axle 10 alongside the guide 11.

The safety device block 2 is preferably constructed as single piece with the leg 4, acting as retaining element, and the leg 5, acting as abutment. The legs 4 and 5 are rigidly connected to the base 2 in such a manner that when blocking further movement of the blocking roller 7, the leg 4 together with the guide and brake lining 6 is pressed against the guide flange 31 on the side opposite the blocking roller 7.

Figure 6:
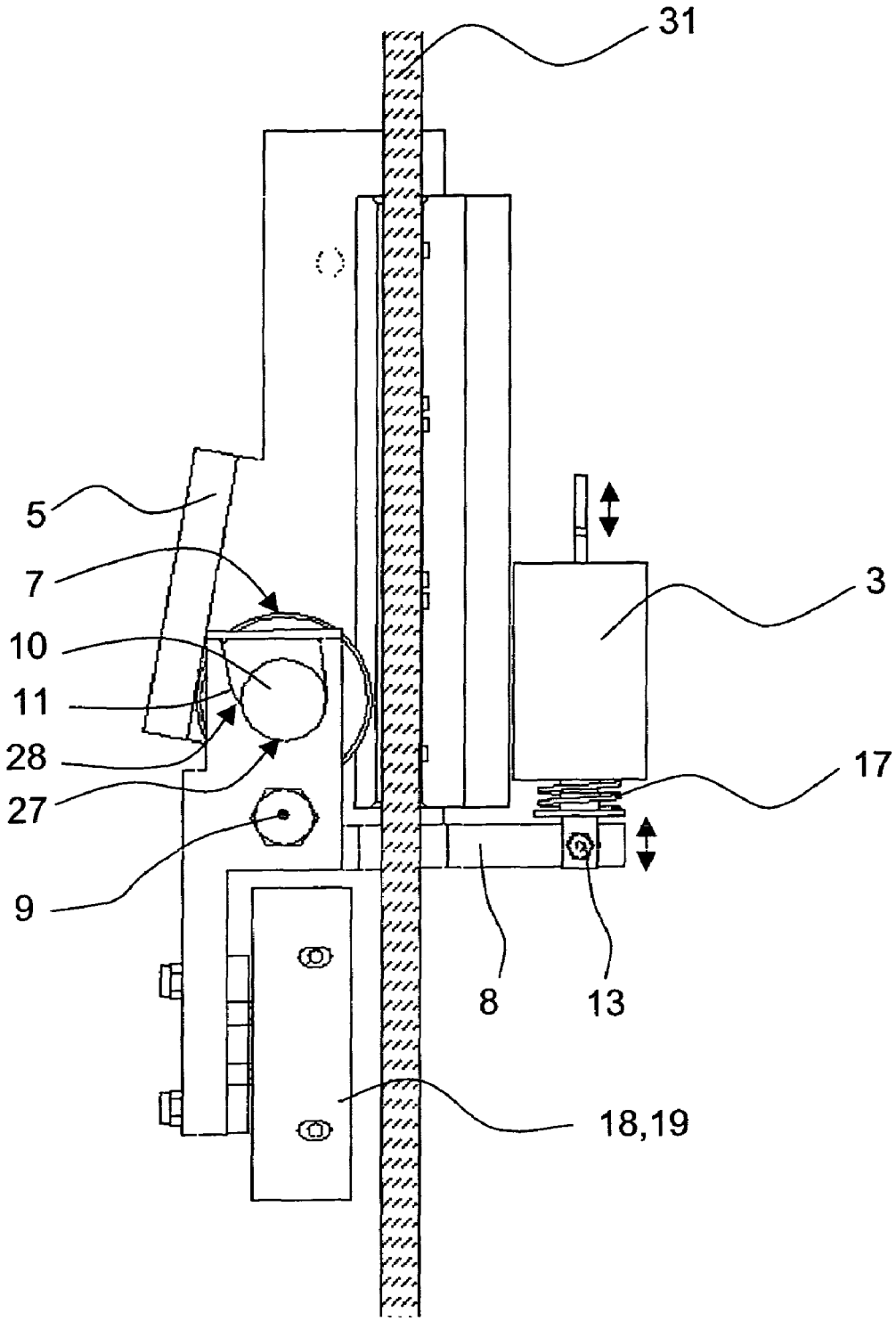
FIG. 6 is a view similar to FIG. 3 with the safety device in a normal state, i.e. with the magnet carrying current.

The lever mechanism 8 includes for example a part, which serves as a suspension 12 for the blocking roller 7. This suspension 12 comprises the guide 11, in which the axle 10 of the blocking roller 7 is moveably placed. The guide 11 can be formed as a groove or respectively as an oblong recess. In order to operate the lever mechanism 8, the electromagnet 3 exhibits a holding or tie bolt 13 connected with the free end of the lever mechanism 8, and such holding or tie bolt 13 can be moved in its lengthwise direction relative to the electromagnet 3, by means of a magnetic field generated with the electromagnet 3, as indicated in FIGS. 1 and 6 by double headed arrows.

Figure 2:
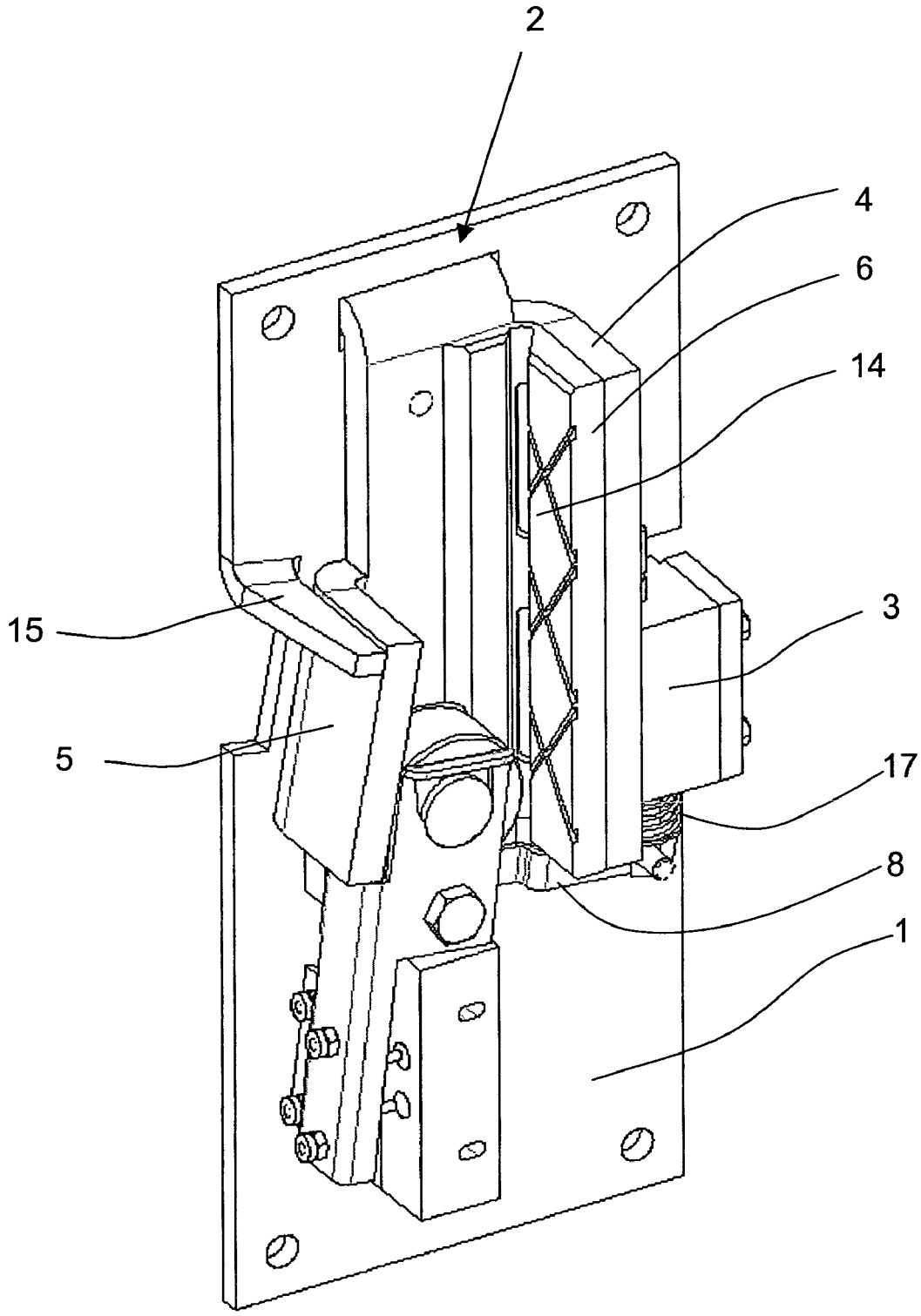
FIG. 2 is another perspective view of the safety device shown in FIG. 1.

In FIG. 2, the base 1 is represented with the safety gear block 2 and the electromagnet 3 in such a manner that a first range with the U-shaped cross section between the two legs 4 and 5 and a second range with an L-shaped cross section as well as a surface structure 14 of the guide and brake lining 6 are clearly visible. In the shown example, the surface structure 14 exhibits an X-shaped applied profile. Over a support 15, being connected with the base 1 on the side of the leg 5 applied from the blocking roller 7, those forces that act on the leg 5 when braking can be absorbed by the base 1.

Figure 3:
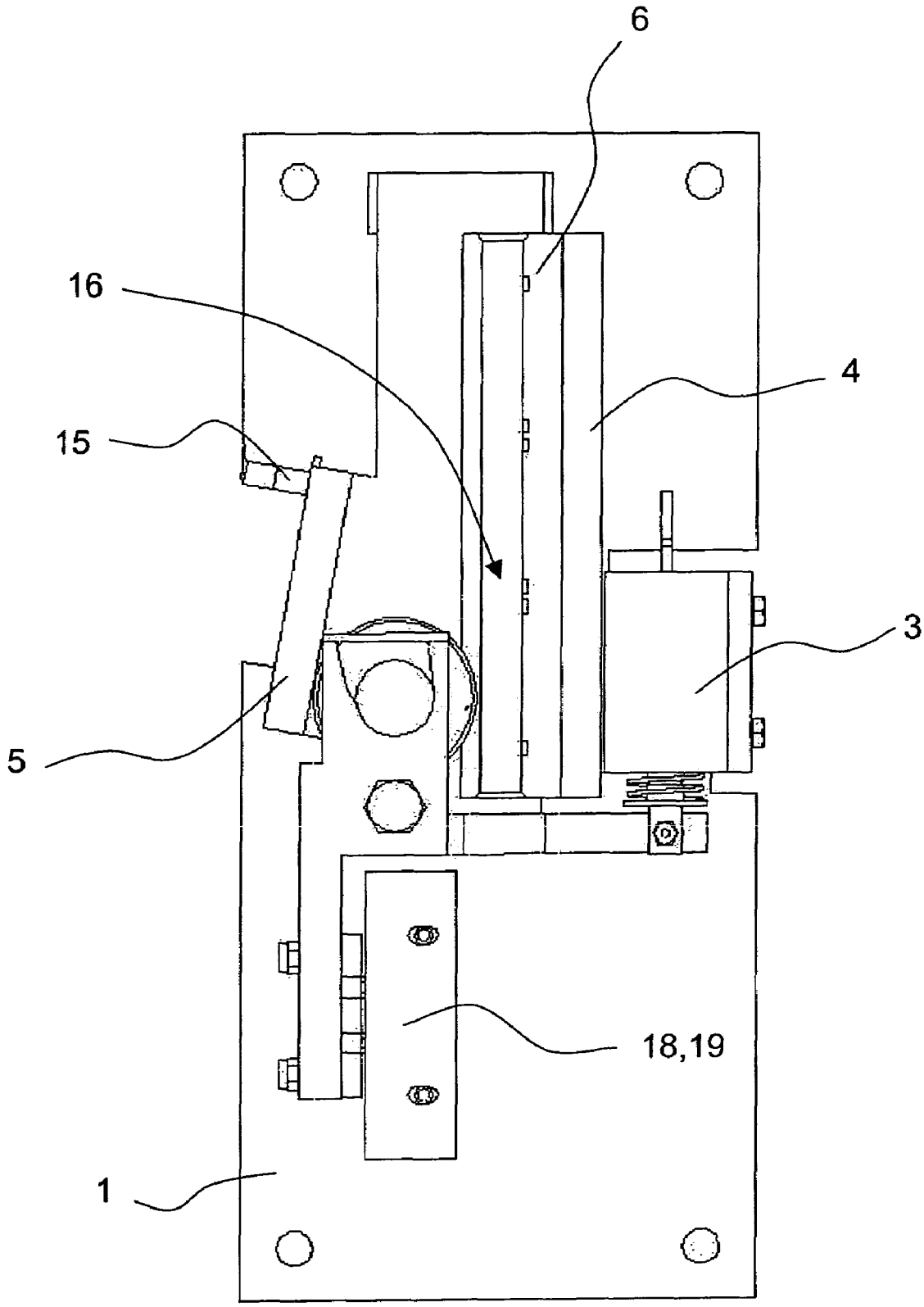
FIG. 3 is a front elevation view of the safety device shown in FIG. 1.
Figure 4:
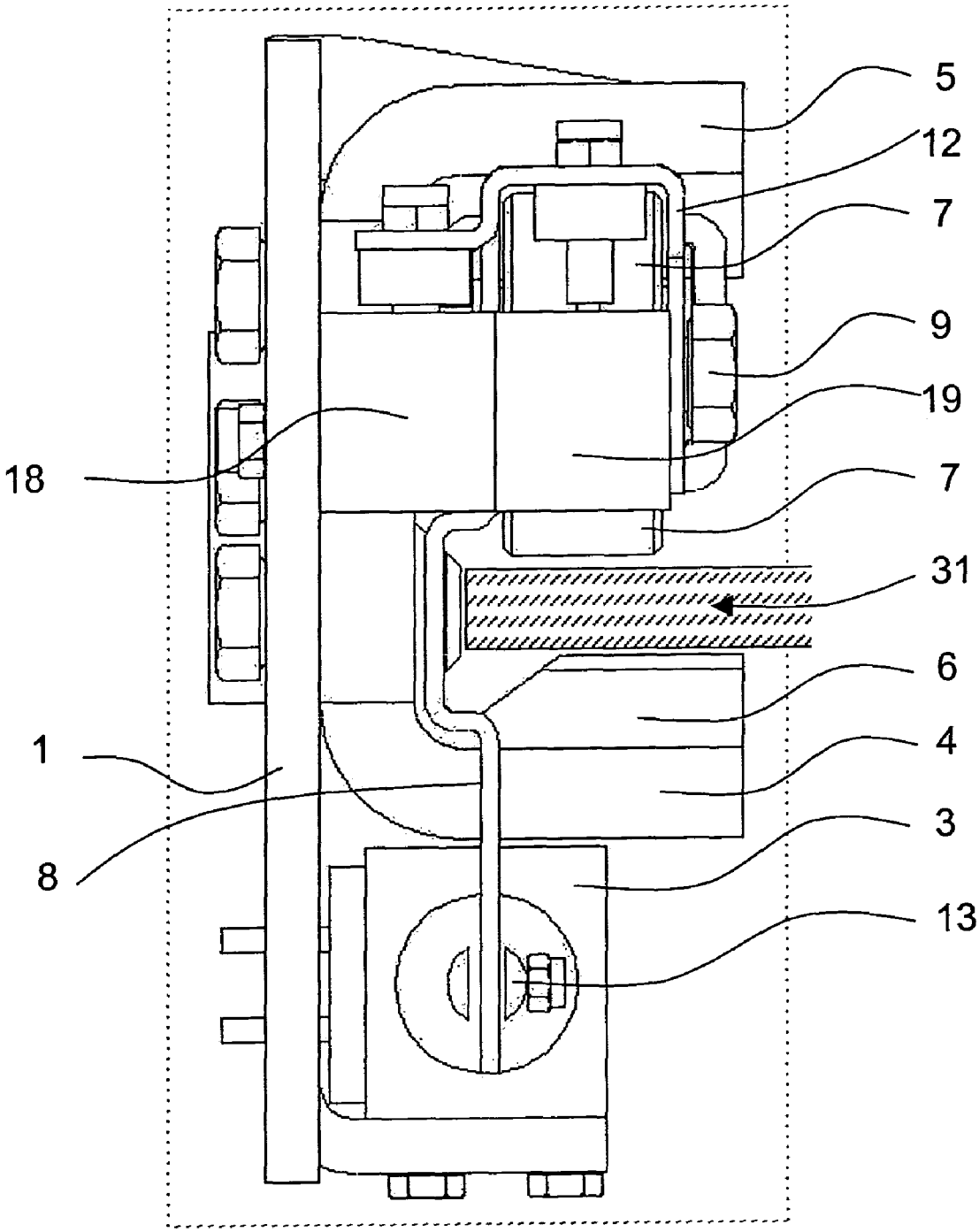
FIG. 4 is a bottom plan view of the safety device shown in FIG. 1.
Figure 5:
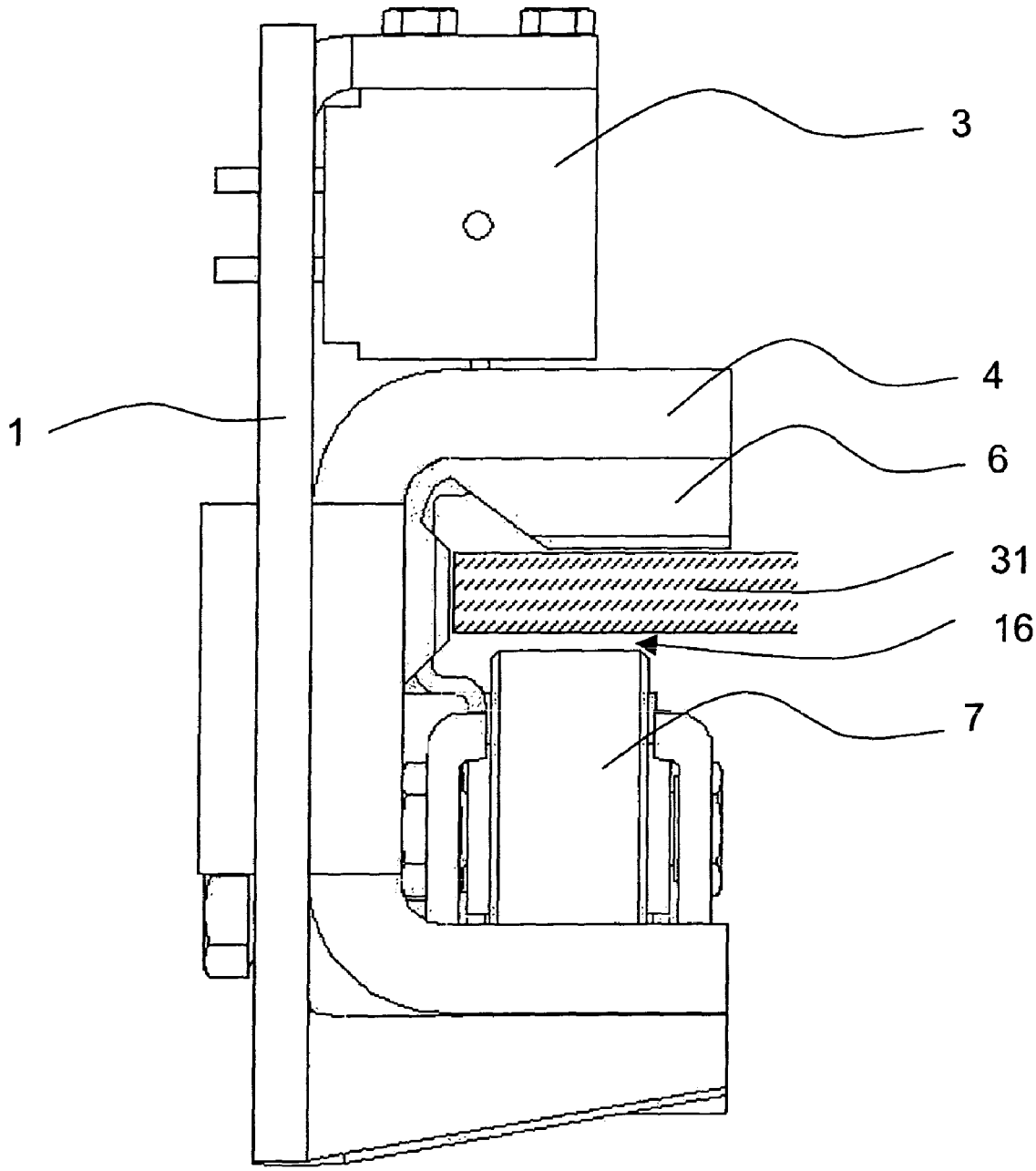
FIG. 5 is a top plan view of the safety device shown in FIG. 1.

From the FIGS. 3, 4 and 5, a free space 16 is clearly evident and such free space 16 is reserved for the guide flange 31 of the guide rail 30. In FIGS. 4 and 5, a part of the guide flange 31 is shown in section.

Figure 7:
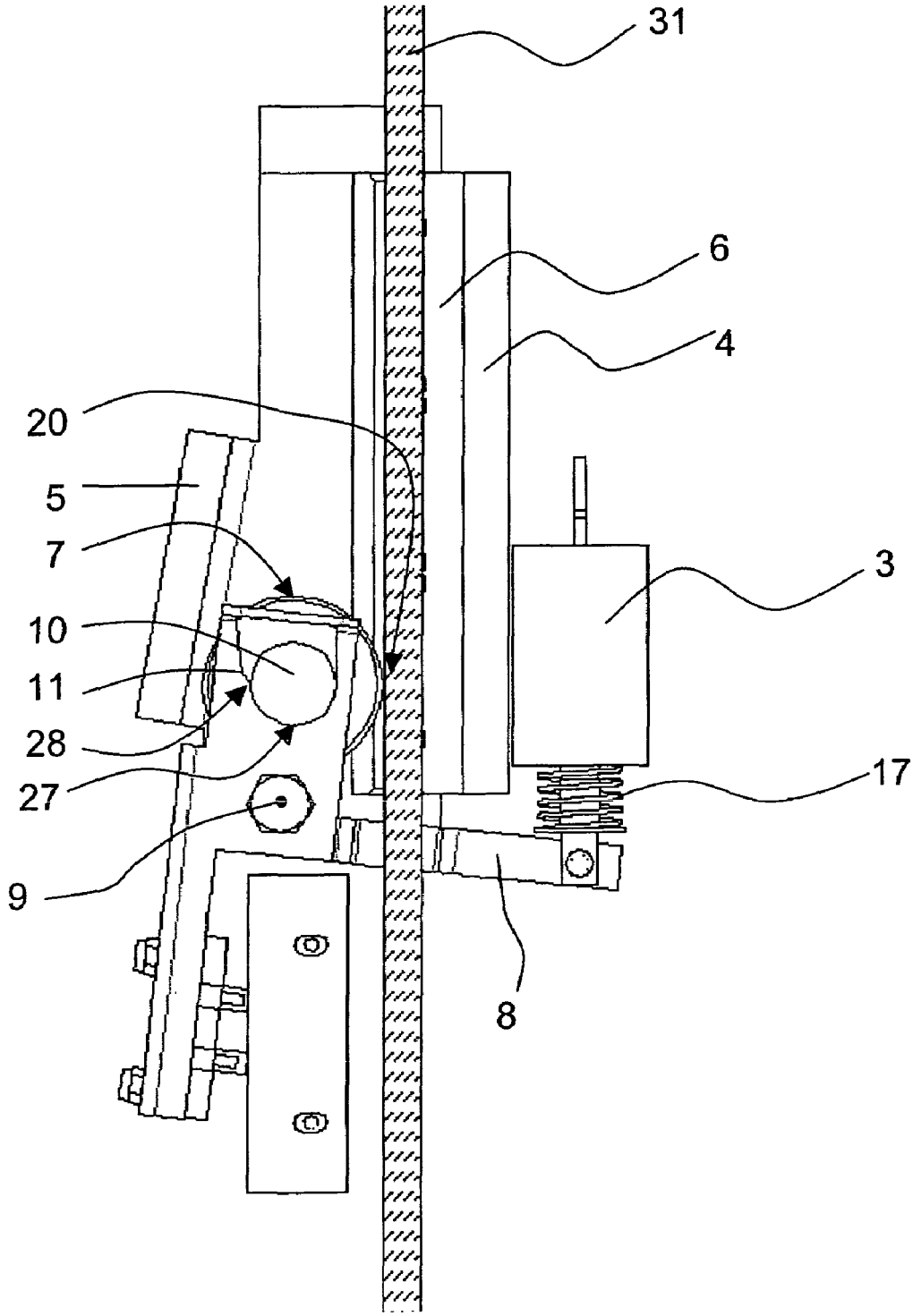
FIG. 7 is a view similar to FIG. 6 with the safety device in readiness for braking with a retaining element without wear.

As shown in FIGS. 1-3 and 6-11, a spring 17 is arranged at the electromagnet 3 and the electromagnet 3 is electrically controllable by means of a release mechanism. In case of a suitable electrical control of the electromagnet 3, the holding or tie bolt 13 can be moved and the free end of the lever mechanism 8 can be deflected against a restoring force of the spring 17. At the same time, the lever mechanism 8 is rotated around the axis of rotation 9 around an appropriate bevel and the position of the blocking roller 7 in the interspace between the leg 5 and the guide flange 31 is changed in a controlled way. In normal operation (driving the elevator car), the electromagnet 3 is current-activated and the holding or tie bolt 13 is held against the spring resistance in an upper extreme position in order to keep the blocking roller 7 distant from the guide flange 31. In this arrangement, the spring 17 is therefore compressed. If the electromagnet 3 is not current-activated, the holding or tie bolt 13 is arranged under the effect of the spring 17 in a position, which is shifted downwards in such a manner that the blocking roller 7 is brought into contact with the guide flange 31 (FIG. 7). If the blocking roller 7 touches the guide flange 31, then the premise is created that the safety device achieves a braking action by an interaction with the guide flange 31. The safety device is then either in the state of braking readiness (braking readiness position), as long as the blocking roller 7 is not squeezed between the guide flange 31 and the leg 5, or in the safety state wherein the blocking roller 7 is squeezed between the guide flange 31 and the leg 5 in a brake position.

In the case of power failure, just as with an appropriate control of the electromagnet 3, the safety device is therefore due to the effect of the spring 17 in the braking readiness state or the safety state.

In FIG. 6, the elevator is in the operating state and in such operating state, the elevator runs undisturbed (standard drive) and the safety brake is arranged in the rest position. The electromagnet 3 is current-activated and the lever mechanism 8 is deflected in such a manner that the blocking roller 7 is out of contact with the guide rail 30. In this position, the axle 10 of the blocking roller 7 rests under effect of the weight on a lowest end or point 27 of the guide 11 of the lever mechanism 8.

Figure 8:
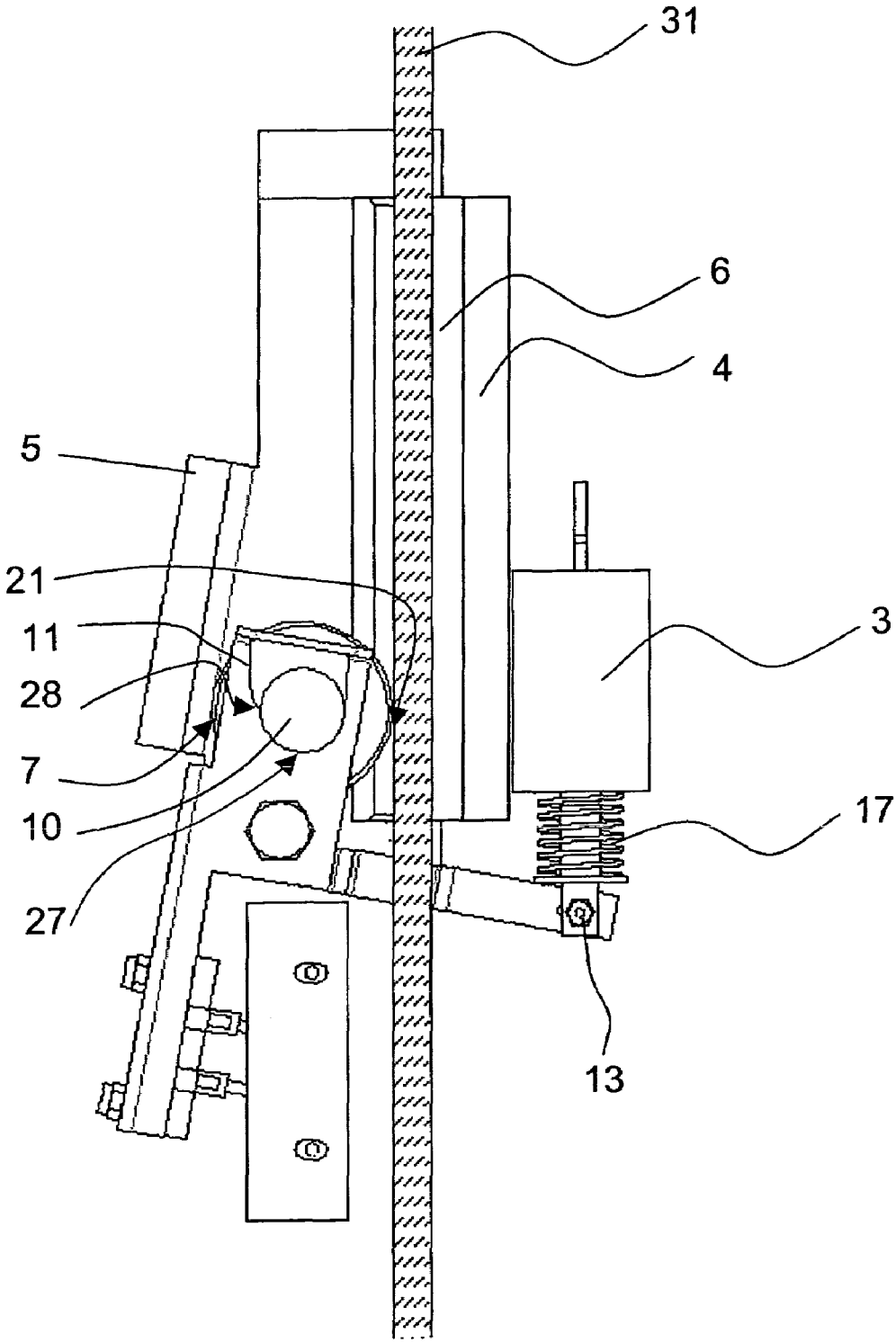
FIG. 8 is a view similar to FIG. 7 showing wear of the retaining element.

FIG. 7 corresponds to an operating state in which the elevator stands for example at a floor stop, so that no relative motion between the guide rail and the elevator car or respectively the safety device takes place. The current supply to the electromagnet 3 is interrupted, whereupon the lever mechanism 8 is so far swiveled that the blocking roller 7 abuts against a zone or portion 20 of the guide flange 31 of the guide rail. The safety device is in the braking readiness position, and no additional loading of the elevator car took place. The blocking roller of 7 rests unaltered at the lower end 27 of the guide 11. FIG. 8 corresponds to the same case, however with a wear of the guide and brake lining 6 of for example 2 mm within a zone or portion 21. In this case, the bolt 13 is somewhat further extended and the blocking roller 7 approaches thereby nearer to the leg 4, since the guide and brake lining 6 became thinner due to wear. The axle 10 of the blocking roller 7 is still placed—as in the case of the FIG. 7—at the lower end 27 of the guide 11.

Figure 9:
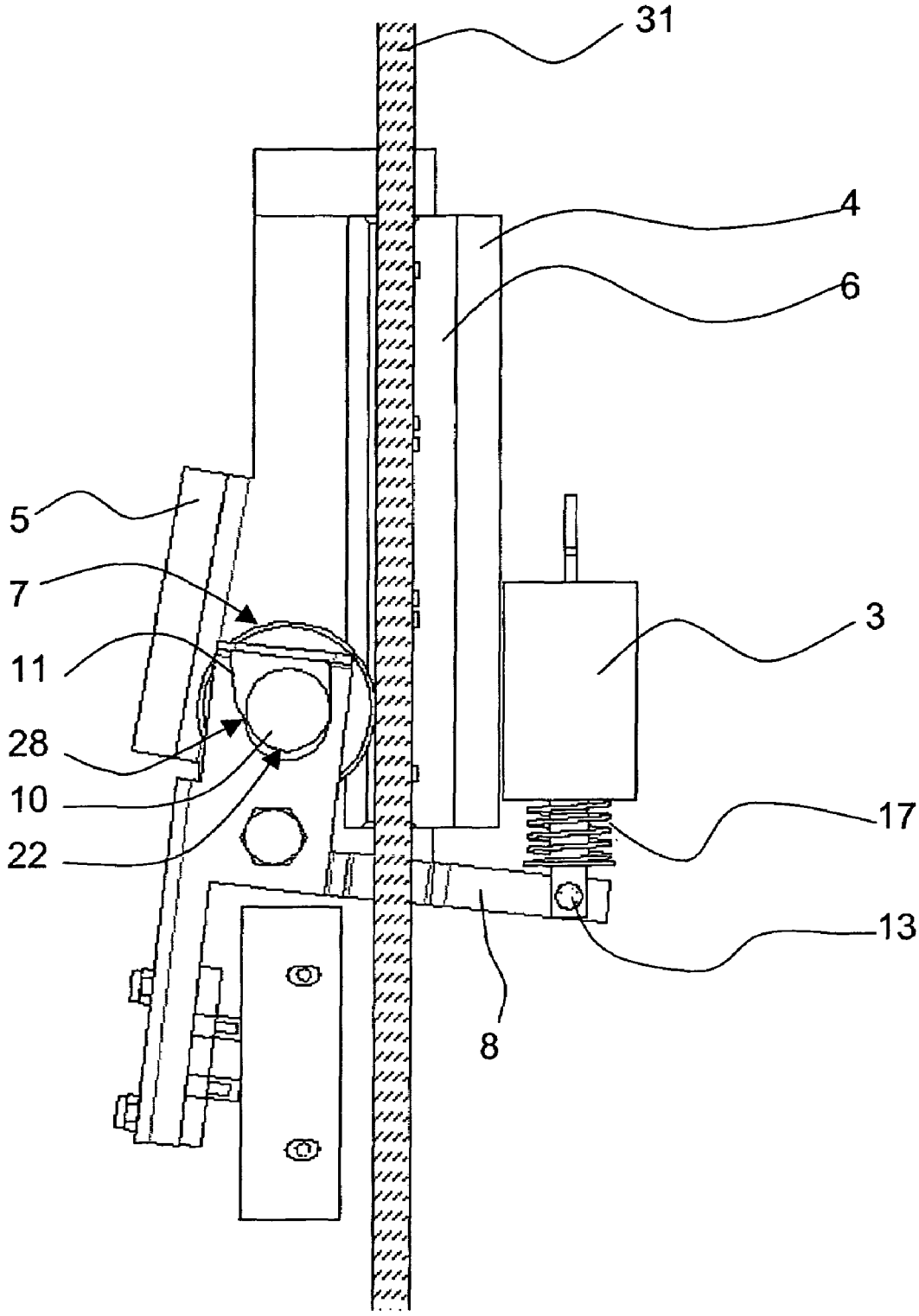
FIG. 9 is a view similar to FIG. 7 with the safety device in readiness for braking with a retaining element without wear, however with an extension of the suspension means of the elevator car.

FIG. 9 serves for the explanation of an operating state, in which the elevator stands and the elevator car was loaded and is lowered consequently within the limits of the elastic resilience of the suspension or respectively of the suspension means, whereupon a movement of the safety device occurred relative to the stationary guide flange 31 of the guide rail 30. During the lowering of the elevator car, the blocking roller 7, which is already adjacent to the guide rail in accordance with FIG. 7, has been put into an anticlockwise rotation under effect of the friction with the guide rail 30 and is rolled along the guide 11. The axis of rotation 10 of the blocking roller 7 has taken thereby a new position 22 (in FIG. 9 defined by the lowest point of the axis of rotation 10), which is shifted opposite to the direction of motion of the elevator car. At the same time, the blocking roller 7 is pushed along closer to the leg 5, however not yet squeezed between the leg and the guide rail. That the blocking roller 7 has automatically changed its position alongside the guide 11 with the described lowering of the elevator car is a consequence of the superposition of all forces affecting the blocking roller 7. These forces are in particular:

(i) the friction between the blocking roller 7 and the guide rail 30;

(ii) the friction between the axle 10 of the blocking roller 7 and the guide 11;

(iii) the weight of the blocking roller 7; and (iv) the force, which is exercised by the guide 11 due to the effect of the forces of the electromagnet 3 and of the spring 17 on the blocking roller 7.

If the safety device is as described in a condition of braking readiness, then the blocking roller 7 is in a state of equilibrium, which changes only if the elevator car changes its position. The state of equilibrium is characterised by the fact that with a suitable adjustment of the guide 11 relative to the guide rail 30, an equilibrium of the forces is set in such a manner that only in a case of a lowering of the elevator car and consequently of the safety gear block 2, the lever mechanism 8 is swivelled relative to the guide rail 30 under effect of the force of the spring 17 (with a lowering of the safety device relative to the guide rail 30, the spring 17 lengthens in its lengthwise direction) and during this swivelling motion the blocking roller 7 rolls alongside the guide 11 and at the same time realises a movement relative to the safety gear block 2, this movement being parallel to the guide rail 30 and opposite the direction of motion of the elevator car. In this way, in the state of braking readiness, the blocking roller 7 takes on a new state of equilibrium after each lowering of the elevator car, and such state of equilibrium exhibits a reduced distance from the leg 5. Therefore, the blocking roller 7 passes through a series of states of equilibrium when lowering the elevator car, until the blocking roller 7 is finally squeezed between the leg 5 and the guide flange 31 and consequently brought into the brake position. The initial tension of the spring 17 and the form of the guide 11 can be co-ordinated for optimization purposes, in order to reliably control the described change of the position of the blocking roller 7 relative to the guide 11 and to the leg 4 in space and time.

If the elevator car is ready for the continuation of the drive, the electromagnet 3 is current-activated and in this manner the lever mechanism 8 and the blocking roller 7 are moved under effect of the electromagnet 3 and of the gravitational force in such a way that the safety device arrives again into the normal or rest position. The described operating sequence recurs with each "stop". The resilience of the suspension and of the suspension means of the elevator car and the geometrical proportions of the safety device are thereby co-ordinated in such a way that by loading the elevator car beyond the permissible maximum weight, the blocking roller 7 rolls so far alongside the guide 11 that the blocking roller 7 is squeezed between the inclined leg 5 and the guide rail and the safety gear is shifted into the safety or brake position. In this way, the function of a creeping protection device is realised with the safety device.

Figure 10:
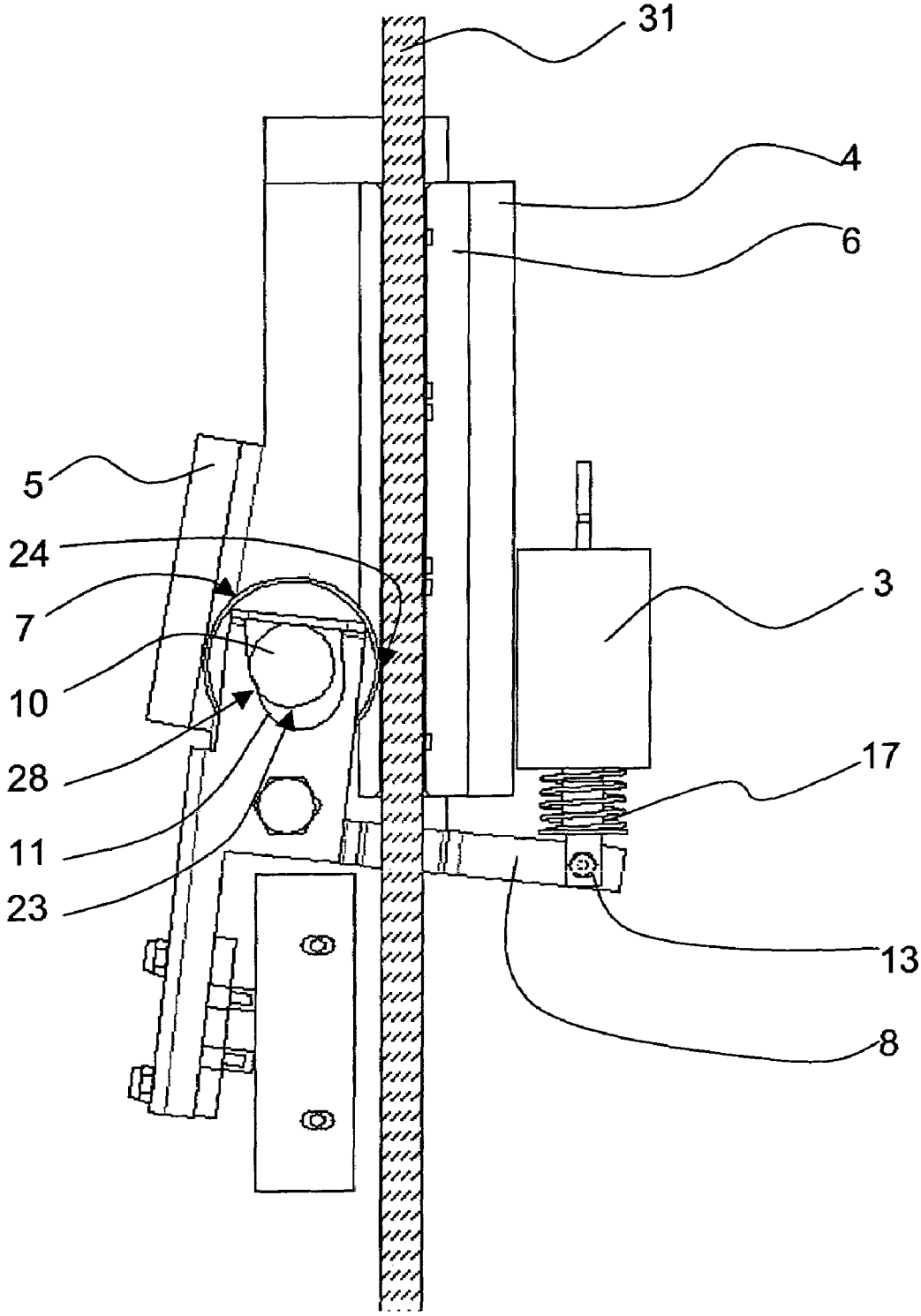
FIG. 10 is a view similar to FIG. 9 with the safety device in the safety position with a retaining element without wear.
Figure 11:
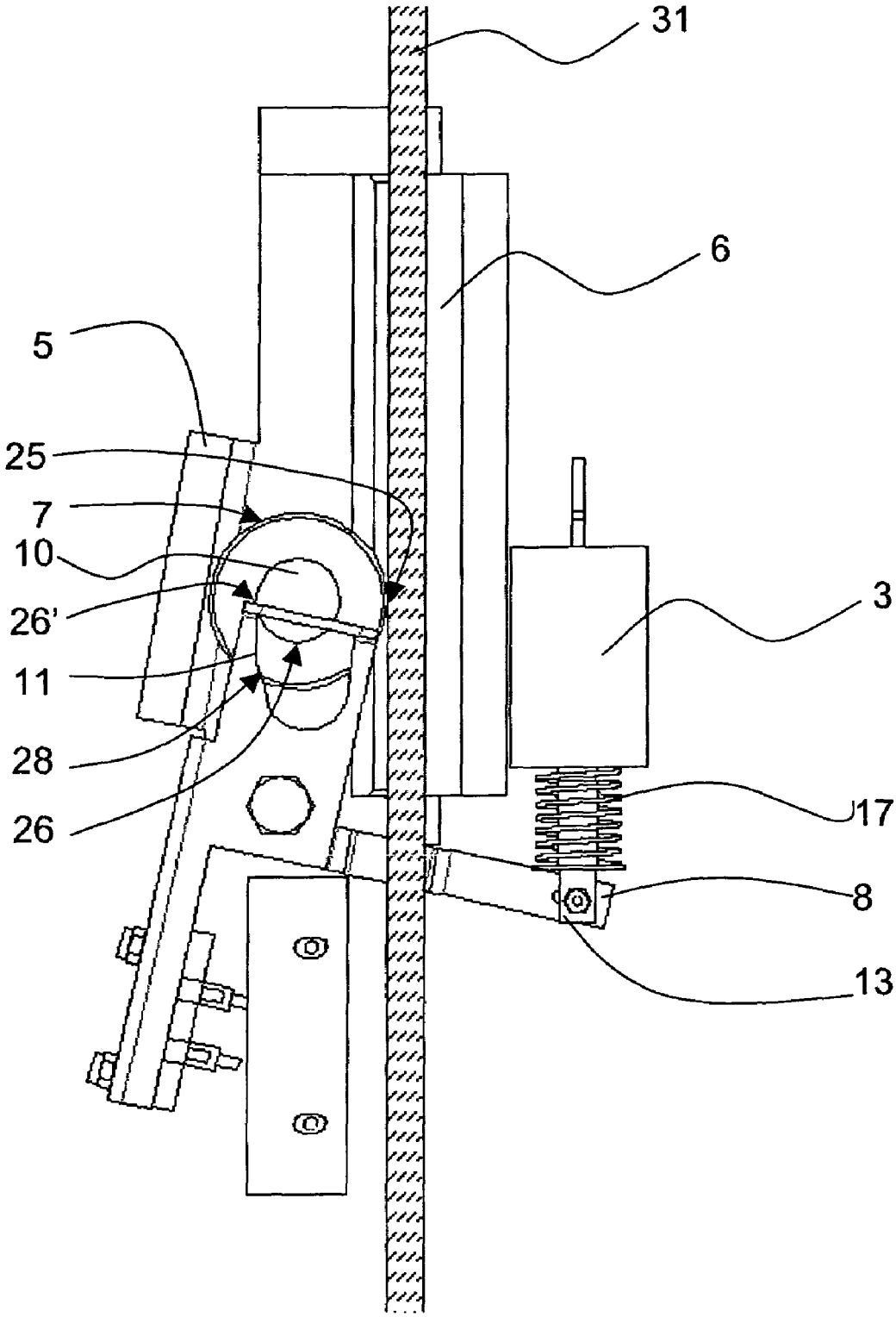
FIG. 11 is a view similar to FIG. 10 showing wear of the retaining element.

FIG. 10 shows a state in which the safety device is shifted into the safety or brake position. As a result of a relative motion between the safety device and the guide flange 31 of the guide rail 30, whose amount exceeds the useful load range described in connection with FIG. 9, the blocking roller 7 moves along the guide 11 up to a position 23 and is now squeezed between the guide rail and the leg 5. The prevailing frictional proportions in a zone or portion 24 lead to further blocking of the blocking roller 7 in case of a further on appearing relative motion. At the same time, the leg 5 is finally pushed from the blocking roller 7 in a direction (left in FIG. 10) away from the guide rail or respectively the blocking roller 7 is pressed against the guide flange 31. FIG. 11 shows the state for example in case of a 2 mm wear of the guide and brake lining 6 with a strong friction in a zone or portion 25. In the final case, the axle 10 takes an extreme position 26 within the upper range of the guide 11.

After that the safety device is set into the safety or brake position, the force of the electromagnet 3 is not sufficient any more in order to release the blocking roller 7 from the blocking and to release again the movement of the elevator car, but rather the safety device is to be released in a so-called reversal drive from the safety position, before the elevator car can be moved again downwards.

The leg 4 has a flat surface, as evident from the figures. The guide and brake lining 6 preferably consists of a material, which preferably exhibits a small coefficient of friction during a small surface pressure and a large coefficient of friction during a large surface pressure. Such materials are for example used in multi-plate clutches or brake linings, well known from the automobile industry point of view. The characteristic of the coefficient of friction that the guide and brake lining 6 exhibits as a result a transition zone is as steep as possible between a range with a low coefficient of friction and a range with a very high coefficient of friction. This enables the utilization of the guide and brake lining 6 for the purpose of braking (in case of a large contact pressure) and for the purpose of guiding (in case of a small contact pressure) subject to the size of the contact pressure between the guide and brake lining 6 and the guide flange 31. In case of a suitable material choice, it is therefore possible to undertake the provided functional combination, according to the present invention, of a brake safety device and a guiding device into a single multi-functional brake in the shape of the present safety device and to optimize independently from each other their employment as a brake device or as a guiding device for the elevator car.

As particularly evident from the FIGS. 6 to 12, the guide 11 does not exhibit a straight-lined form for the axle 10 of the roller 7, but it is provided with a middle portion 28, in which it makes first a curve to the right and then a curve to the left. This curvature course can be optimized depending upon each employment. The detailed course of the guide 11 between the lower end 27 and the upper extreme position 26 determines in which measure the blocking roller 7 changes its position relative to the leg 5, if the safety device block 2 is moved around a given measure alongside the guide rail 30. This change is anyhow non-linear as a function of the path alongside the guide rail 30, if the guide 11 exhibits a curved course.

Figure 12:
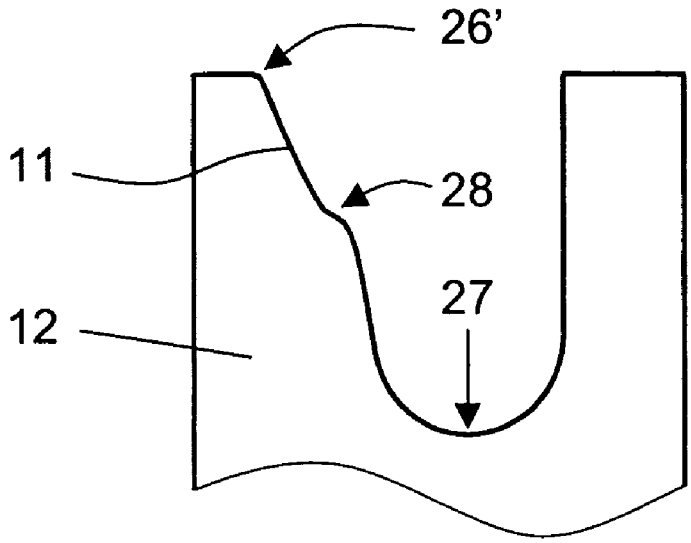
FIG. 12 is a schematic representation of an embodiment of the suspension of the blocking roller of the safety device.

A peculiarity, which can be brought back to the special course of the curvature of the guide 11, is represented in FIG. 12. The curvature of the guide is at the same time exaggeratedly represented for reasons of clarity. The suspension 12 of the lever mechanism 8 is developed in accordance with FIG. 12 in such a manner that, depending on the operating state, the position of the axle 10 of the blocking roller 7 is changed along the guide 11 at two locations in an at least approximately discontinuous manner. The average lengthwise direction of these grooves or oblong recesses forms preferably an angle with the direction of motion of the elevator car. The guide 11 exhibits, because of its curvilinear course, several locations at which the blocking roller 7 can take, due to its form, a stable position—in the following designated as locking position—if the blocking roller were transported alongside the guide of 11 to one of these locking positions as a result of the mechanisms described before. If the blocking roller 7 has arrived alongside the guide 11 at one of these locking positions, then the lever mechanism 8 takes under the effect of the spring 17 a position in which the guide 11 supports the blocking roller 7 in such a way, that the position of the blocking roller 7 is not substantially influenced through small changes in the deflection of the lever mechanism 8 and is therefore stabilized, in particular against the influence of the weight of the blocking roller 7. The suspension 12 has a lower locking position at the lower end 27 of the guide 11 for the normal operation in the normal state of the safety device in case of current-activated electromagnet 3, a middle locking position within the middle portion 28 or above the middle portion 28 of the guide 11 for the operation as creeping protection device or respectively for the operation of the safety device in the safety position in each case with a not current-activated electromagnet 3, and an upper locking position at an extreme position 26' at the upper end of the guide 11.

Figure 13:
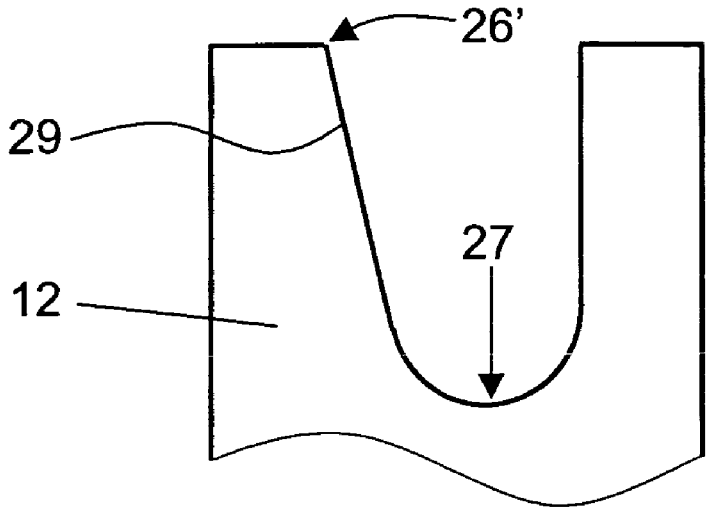
FIG. 13 is a schematic representation of a simpler embodiment of the suspension of the blocking roller.

FIG. 13 shows a guide 29, which can be used as a simplified alternative to the guide 11 in the safety device and which exhibits a linear course. In the example according to FIG. 13, the guide 29 does not exhibit any change of direction. In this case, there is no locking position in the middle portion of the guide 29 for more precisely controlling the position of the blocking roller 7 in case of operation as creeping protection device, in contrast to the example in accordance with FIG. 12.

Figure 14:
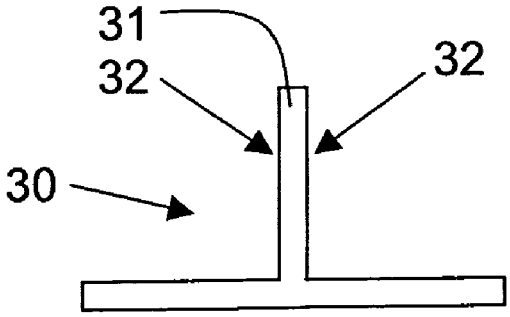
FIG. 14 is a schematic representation of a guide rail with a guide flange in cross section.

FIG. 14 shows an example of the simple guide rail 30 with the guide flange 31, whose thickness is so designed that it fits into the free space 16 (see FIGS. 3 and 5). The guide rail 30 with the guide flange 31 is vertically arranged in the elevator hoistway. Preferably, two guide rails with guide flange are arranged laterally to the elevator car. The elevator car carries in this case two or four safety devices, which stand in interaction with the guide rails. The principle of the present invention is however independent from the thickness or form of this guide flange, provided that at least one guide surface 23 is available.

The momentary position of the electromagnet 3 and, thus, the condition of the safety device is ascertained in the shown example by two switches 18 and 19, which supervise the position of the holding or tie bolt 13 or respectively the deflection of the lever mechanism 8 and consequently also the operating state of the safety device. The one switch 18 is provided in order to indicate whether the safety device of the elevator installation is in readiness and the other switch 19 (also called "brake—in engagement—switch") is provided in order to indicate whether the safety device is in the safety position. The brake—in engagement—switch is advantageously integrated into the safety circuit of the elevator.

Figure 15:
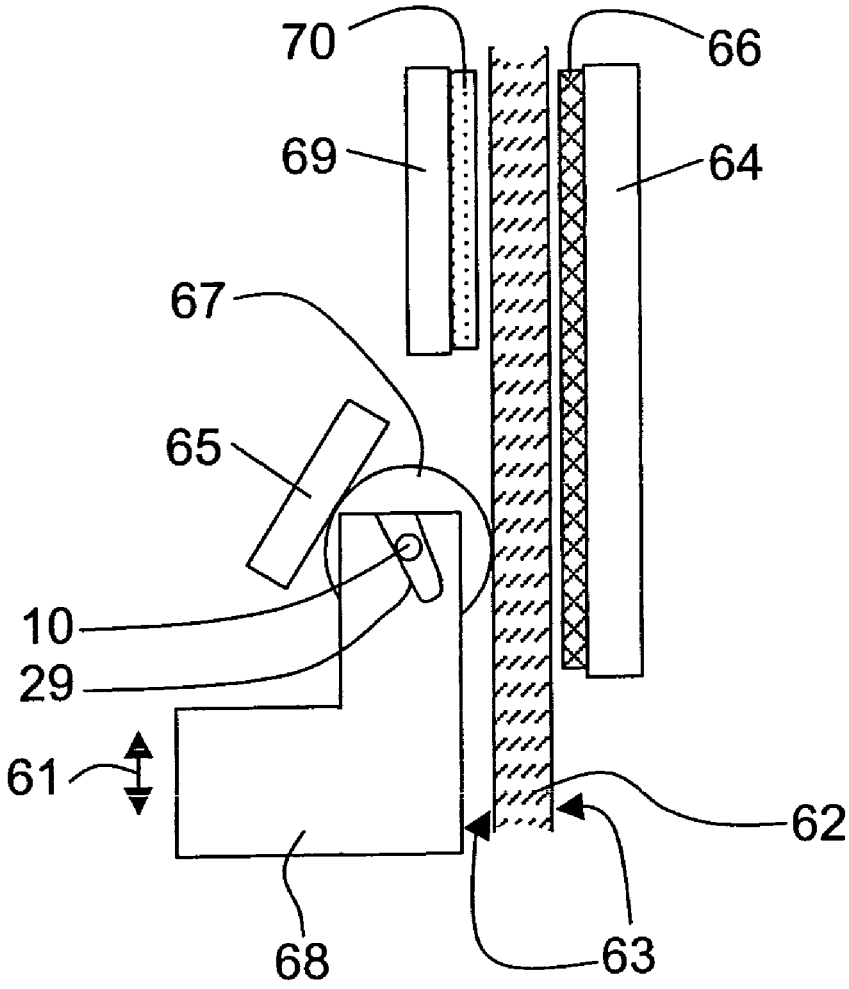
FIG. 15 is a schematic representation of a further embodiment safety device in accordance with the present invention.

In a further embodiment of the invention, the safety device can exhibit a two-dimensional or even a three-dimensional guide for the elevator car at the safety device block. Such an example is represented in FIG. 15. The safety device, in accordance with FIG. 15, exhibits beside a blocking roller 67, which is guided alongside the guide 29, a retaining element 64 with a guide and a brake lining 66 and an abutment 65. A lever mechanism 68 is available, which is pivoted as indicated by a double arrow 61. Through the lever mechanism 68, the blocking roller 67 can be brought into a brake position, and in such brake position, the blocking roller 67 is squeezed between a guide surface 63 of an oblong guide flange 62 installed in the elevator hoistway and the abutment 65. The safety device comprises an operating mechanism (e.g. an electromagnet, or a mechanical, or pressure controlled mean), which is arranged in such a manner that it acts upon the blocking roller 67 by means of this operating mechanism and lever mechanism 68 in order to change the position of the blocking roller 67 with respect of the oblong guide flange 62. The safety device is thereby characterised in accordance with FIG. 15 by an additional guiding device 69 that is provided, whose guide surface is provided with a guide lining 70. The guide lining 70 can be realised in a different way in respect to the guide and brake lining 66, for example as a wear resistant lining with a small coefficient of friction. The latter is meaningful since the guiding device 69 has exclusively a guide function and, in contrast to the retaining element 64, it does not deploy any braking action.

Furthermore, a suitable safety switch (not shown) can be provided, which measures and/or controls the wear of the guide lining and in case of excessive wear, it stops the elevator.

The multi-functional safety device is brought into the state of braking readiness with each stop in the regular driving of the elevator in accordance with the invention, as the current of the electromagnet is switched off. The execution of the safety device allows the lowering of the elevator car in the stopping place in case of loading, without the safety devices getting blocked with the guide rail. By moving the safety devices at each stop, a quasi-automatic checking of the functional efficiency of the multi-functional rail brake takes place.

There are further conceivable embodiments of the invention, which emanate from modifications of the described safety devices. As a braking element also wedges, ellipsoids or other objects can be considered in place of the described blocking roller, if they are squeezable due to their form. Instead of the described lever mechanism, each mechanism can be considered if with this mechanism the position of the braking element can be changed in a controlled manner, in order to guarantee the described functionality of the safety device. The described electromagnet could be replaced by another operating mechanism, which is suitable for changing, via a controlled force effect, the position of the braking element in such a manner that the safety device changes from the normal state into the state of the braking readiness and inversely. Obviously, the described switches 18 and 19 can be replaced also by a sensor, which is suitable to characterize the momentary position of the braking element or respectively their change in order to seize the momentary operating state of the safety device and as the case may be to derive thereon signals for controlling the elevator. The safety device can also be developed for braking for any direction of motion alongside a guide rail. The abutment must be merely aligned according to the respective suitable purpose relative to the guide rail, in order to enable a squeezing of the braking element. Further on, the braking element must be guided accordingly, in order to enable an automatic transition between the normal position of the safety device in the state of the braking readiness and from there in the respective safety position. In case of suitable guidance of the braking element and a suitable arrangement of the appropriate abutment, a single safety device can be designed on the basis of the present invention for the purpose of braking alongside each of the two directions of motion, which can be realised alongside a guide rail.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety device for braking an elevator car in an elevator system, the elevator system including at least one guide rail having at least one guide surface thereon, the safety device comprising:

a retaining element;

an abutment spaced from and fixed relative to said retaining element;

a braking element movably positioned between said retaining element and said abutment and spaced a distance from said retaining element sufficient to accept a portion of a guide rail therebetween, said braking element having a rest position spaced from a guide surface of the guide rail;

a lever mechanism connected to said braking element for moving said braking element from said rest position to a braking readiness position contacting the guide surface of the guide rail when the elevator car is stopped whereby when said safety device is mounted on the elevator car and said braking element is in said braking readiness position, subsequent downward movement of the elevator car causes said braking element be squeezed between the guide surface of the guide rail and said abutment for braking the elevator car; and an operating mechanism connected to said lever mechanism for selectively moving said braking element between said rest position and said braking readiness position when the elevator car is stopped and wherein a position of said braking element is changeable along a guide of said lever mechanism.

2. The safety device according to claim 1 wherein said braking element is a blocking roller.

3. The safety device according to claim 1 wherein said abutment is angled relative to said retaking element whereby an interspace between said retaining element and said abutment narrows opposite a predetermined direction of motion of the elevator car.

4. The safety device according to claim 1 wherein said lever mechanism swivels around an axle.

5. The safety device according to claim 1 wherein said guide is formed by a groove or an oblong recess in a suspension of said blocking roller.

6. The safety device according to claim 1 said guide is shaped to hold said braking element in said rest position.

7. The safety device according to claim 1 wherein said operating mechanism applies a force to said braking element for bringing said braking element into contact with the guide surface and keeping said braking element in a state of equilibrium whereby during a movement of the elevator car, said braking element is moved automatically relative to said abutment and opposite to the direction of motion of the elevator car.

8. The safety device according to claim 1 wherein said operating mechanism includes an electromagnet activated by electrical current to act upon said lever mechanism to maintain said braking element in said rest position away from the guide surface.

9. The safety device according to claim 1 wherein the guide surface is one guide surface of the guide rail and said retaining element is a first guiding element for guiding the elevator car alongside another guide surface of the guide rail.

10. The safety device according to claim 1 wherein said retaining element and said abutment are formed as legs of a U-shaped safety device block attached to a base and an interspace between said abutment leg and the guide surface is narrowed opposite the direction of motion of the elevator car.

11. The safety device according to claim 1 wherein said retaining element has a guide and brake lining attached thereto, said guide and brake lining being made of a material that exhibits a small coefficient of friction in response to a small surface pressure and a large coefficient of friction in response to a large surface pressure.

12. The safety device according to claim 8 wherein said electromagnet includes a bolt connected to said lever mechanism and a spring acting on said bolt, whereby when said electromagnet is activated by electrical current, said bolt is moved by a magnetic field to maintain said braking element in said rest position against a force applied by said spring, and when said electromagnet is not activated, said spring moves said braking element toward said braking readiness position.

13. The safety device according to claim 12 wherein said force applied by said spring is a preload on said braking element and when said electromagnet is not activated, said braking element moves automatically with a movement of the elevator car relative to said abutment and opposite to the direction of motion of the elevator car under said preload.

14. The safety device according to claim 9 including a second guiding element spaced a distance from said first guiding element for guiding the elevator car alongside the one guide surface.

15. The safety device according to claim 14 wherein said retaining element and said second guiding element form parts of a safety device block.

16. A safety device for braking an elevator car in an elevator system, the elevator system including at least one guide rail having at least one guide surface thereon, the safety device comprising:

a first leg having a guide and brake lining attached thereto;

a second leg spaced from and fixed relative to said first leg;

a blocking roller movably positioned between said first leg and said second leg and spaced a distance from said first leg sufficient to accept a portion of a guide rail therebetween, said blocking roller having a rest position spaced from a guide surface of the guide rail;

a lever mechanism connected to said blocking roller for moving said blocking roller from said rest position to a braking readiness position contacting the guide surface of the guide rail when the elevator car is stopped whereby when said safety device is mounted on the elevator car and said blocking roller is in said braking readiness position, subsequent downward movement of the elevator car causes said blocking roller be squeezed between the guide surface of the guide rail and said second leg for braking the elevator car; and an operating mechanism connected to said lever mechanism for selectively moving said blocking roller between said rest position and said braking readiness position when the elevator car is stopped and wherein a position of said braking element is changeable along a guide of said lever mechanism.

17. The safety device according to claim 16 said first leg and said second leg are formed as legs of a U-shaped safety device block attached to a base and an interspace between said second leg and the guide surface is narrowed opposite the direction of motion of the elevator car.

* * * * *